US010025248B2

(12) United States Patent
Kikuchi et al.

(10) Patent No.: US 10,025,248 B2
(45) Date of Patent: Jul. 17, 2018

(54) IMAGE FORMING APPARATUS HAVING A SELECTING PORTION FOR SELECTING AN EXECUTION ORDER OF A NUMBER OF FIXING OPERATIONS

(71) Applicant: CANON KABUSHIKI KAISHA, Tokyo (JP)

(72) Inventors: Nobuhiro Kikuchi, Moriya (JP); Yasuharu Chiyoda, Nagareyama (JP); Masahiro Tsujibayashi, Nagareyama (JP); Satoru Yamamoto, Noda (JP); Katsuya Nakama, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/136,256

(22) Filed: Apr. 22, 2016

(65) Prior Publication Data

US 2016/0327895 A1 Nov. 10, 2016

(30) Foreign Application Priority Data

May 8, 2015 (JP) ..... 2015-095640
Mar. 3, 2016 (JP) ..... 2016-040917

(51) Int. Cl.
*G03G 15/00* (2006.01)
*G03G 15/20* (2006.01)
*G03G 21/16* (2006.01)

(52) U.S. Cl.
CPC ..... *G03G 15/5016* (2013.01); *G03G 15/2032* (2013.01); *G03G 15/5079* (2013.01);
(Continued)

(58) Field of Classification Search
CPC ..... G03G 15/2032; G03G 15/5079; G03G 21/1685
(Continued)

(56) References Cited

U.S. PATENT DOCUMENTS 7,660,553 B2 2/2010 Kikuchi
8,145,086 B2 3/2012 Chiyoda et al.
(Continued)

FOREIGN PATENT DOCUMENTS

JP 2000131978 A 5/2000
JP 2004029381 A 1/2004
(Continued)

OTHER PUBLICATIONS

Copending, unpublished U.S. Appl. No. 15/048,082 dated Feb. 19, 2016, to Junichi Moteki et al.
(Continued)

*Primary Examiner* — William J Royer
(74) *Attorney, Agent, or Firm* — Fitzpatrick, Cella, Harper & Scinto

(57) ABSTRACT

An image forming apparatus includes an input portion into which a job is to be input, an image forming portion configured to form a toner image on a recording material to execute the job input into the input portion, a fixing portion configured to fix, on the recording material, the toner image formed by the image forming portion, the fixing portion being capable of being replaced with another fixing portion depending on a content of the job, a selecting portion configured to prompt an operator to select one of a plurality of modes before a plurality of jobs are successively reserved, and a controller configured to control the execution order of reserved jobs. The controller can change the execution order of the plurality of jobs so as to decrease the number of times of replacement of the fixing portion, or the controller can maintain the execution order of the plurality of jobs in a reserved order.

25 Claims, 8 Drawing Sheets

(52) U.S. Cl.
CPC ..... *G03G 21/1685* (2013.01); *G03G 2215/00514* (2013.01)

(58) Field of Classification Search
USPC ..... 399/67, 81, 82, 85, 122
See application file for complete search history.

(56) References Cited

U.S. PATENT DOCUMENTS

| | | | | |
|---|---|---|---|---|
| 8,306,446 | B2 | 11/2012 | Ito et al. | |
| 8,395,090 | B2 | 3/2013 | Chiyoda | |
| 8,873,986 | B2 | 10/2014 | Chiyoda | |
| 8,971,745 | B2 * | 3/2015 | Isobe et al. | G03G 15/20 399/67 |
| 9,075,355 | B2 | 7/2015 | Chiyoda et al. | |
| 9,261,825 | B2 | 2/2016 | Chiyoda | |
| 9,298,140 | B2 | 3/2016 | Moteki et al. | |
| 9,304,462 | B2 | 4/2016 | Chiyoda | |
| 2005/0271432 | A1 | 12/2005 | Chiba | |
| 2007/0003298 | A1 | 1/2007 | Amico | |
| 2008/0075490 | A1 | 3/2008 | Ota et al. | |
| 2008/0089729 | A1 | 4/2008 | Fujita et al. | |
| 2008/0292379 | A1 | 11/2008 | Tsuchiya | |
| 2011/0229183 | A1 | 9/2011 | Seki et al. | |
| 2011/0286765 | A1 | 11/2011 | Murakami | |
| 2012/0076510 | A1 | 3/2012 | Mizuno et al. | |
| 2013/0051826 | A1 | 2/2013 | Chiyoda | |
| 2013/0100467 | A1 | 4/2013 | Miyazaki | |
| 2013/0142534 | A1 | 6/2013 | Isobe et al. | |
| 2014/0369726 | A1 | 12/2014 | Soeda | |
| 2016/0216653 | A1 | 7/2016 | Yajima et al. | |

FOREIGN PATENT DOCUMENTS

| | | | |
|---|---|---|---|
| JP | 2004210494 | A | 7/2004 |
| JP | 2005351939 | A | 12/2005 |
| JP | 2006123421 | A | 5/2006 |
| JP | 200711354 | A | 1/2007 |
| JP | 2007065084 | A | 3/2007 |
| JP | 2007101904 | A | 4/2007 |
| JP | 2008-058365 | A | 3/2008 |
| JP | 200852543 | A | 3/2008 |
| JP | 2011197054 | A | 10/2011 |
| JP | 201268560 | A | 4/2012 |
| JP | 201388683 | A | 5/2013 |
| JP | 2013120222 | A | 6/2013 |
| JP | 20151660 | A | 1/2015 |
| JP | 201560208 | A | 3/2015 |
| JP | 2015041036 | A | 3/2015 |

OTHER PUBLICATIONS

Copending, unpublished U.S. Appl. No. 15/048,208 dated Feb. 19, 2016, to Junichi Moteki et al.
European Search Report issued in European Patent Application No. 16164611.2, dated Oct. 17, 2016.
Japanese Office Action issued in corresponding Japanese Application No. 2016-040917 dated Dec. 6, 2016.
European Search Report issued in corresponding European Application No. 16164611.2 dated Jan. 17, 2017.

* cited by examiner

IMAGE FORMING APPARATUS HAVING A SELECTING PORTION FOR SELECTING AN EXECUTION ORDER OF A NUMBER OF FIXING OPERATIONS

FIELD OF THE INVENTION AND RELATED ART

The present invention relates to an image forming apparatus for forming a toner image on a recording material. As this image forming apparatus, it is possible to use a copying machine, a printer, a facsimile machine and a multi-function machine having functions of these machines.

In recent years, species of media (recording materials: hereinafter also referred to as sheets) usable in image forming apparatuses of an electrophotographic type diversify in accordance with various customer needs. In the case where the image is formed on a special recording material such as an envelope, compared with other recording materials, it is required that pressure of a fixing device (apparatus) is largely changed.

In order to satisfactorily effect image formation on the media of such various species, an image forming apparatus in which an exclusive fixing device depending on the species of the recording material is prepared and the fixing device used is exchanged (replaced) in accordance with the recording material used has been proposed (Japanese-Laid Open Patent Application (JP A) 2008 58365).

However, in such an image forming apparatus, there is a problem as described below. For example, the case where a fixing device A suitable for various recording materials such as high-quality paper and coated paper and a fixing device B substantially specialized for the envelope are prepared and a plurality of jobs different in species of the recording material are executed will be considered. Specifically, for example, the case where a first job is a job using the envelope, a next job is a job using the high-quality paper and a final job is a job using the envelope will be assumed.

These three jobs are executed in such an order that first image formation on the envelope is effected using the fixing device B, and then the fixing device B is exchanged for the fixing device A, and image formation on the high-quality paper is effected. Finally, the fixing device A is exchanged for the fixing device B, and image formation on the envelope is effected.

In this case, exchange of the fixing device is needed two times, and therefore, the time and trouble for a user to exchange the fixing device increase. Accordingly, when such three jobs are executed, there is a demand of the user such that the user wants to decrease the number of times of exchange of the fixing device. On the other hand, there is also a demand of the user such that the user wants to successively execute the jobs along a reserved order of the three jobs. It is required to meet such a variety of demands of the user.

SUMMARY OF THE INVENTION

According to an aspect of the present invention, there is provided an image forming apparatus comprising: an image forming portion configured to form a toner image on a recording material to execute a job; a fixing portion configured to fix, on the recording material, the toner image formed by the image forming portion, the fixing portion being capable of being replaced with another fixing portion depending on a content of the job; and a selecting portion configured to cause an operator to select one of a plurality of modes when a plurality of jobs are successively reserved, the plurality of modes including a first mode in which execution order is changed so as to decrease a number of times of replacement of the fixing portion and then the plurality of jobs are executed in the changed execution order and a second mode in which the plurality of jobs are executed in reserved order.

According to another aspect of the present invention, there is provided an image forming apparatus comprising: an image forming portion configured to form a toner image on a recording material to execute a job; a fixing portion configured to fix, on the recording material, the toner image formed by the image forming portion; a mounting portion configured to selectively mount one of a plurality of fixing portions of species including a first fixing portion capable of fixing the toner image on the recording material of a predetermined species including a predetermined envelope and a second fixing portion capable of fixing the toner image on the recording material of a predetermined species not including the predetermined envelope; and a selecting portion configured to cause an operator to select one of a plurality of modes when a first job using a first fixing portion, a second job using a second fixing portion and a third job using a first fixing portion are successively reserved, the plurality of modes including a first mode in which the first job, the third job and the second job are executed in listed order and a second mode in which the first job, the second job and the third job are executed in listed order.

According to another aspect of the present invention, there is provided an image forming apparatus comprising: an image forming portion configured to form a toner image on a recording material to execute a job; a fixing portion configured to fix, on the recording material, the toner image formed by the image forming portion; a mounting portion configured to selectively mount one of a plurality of fixing portions of species including a first fixing portion capable of fixing the toner image on the recording material of a predetermined species including a first recording material and a second fixing portion capable of fixing the toner image on the recording material of a predetermined species not including the first recording material; a determining portion configured to detect a number of times of replacement of the fixing portions in a process in which a plurality of jobs are executed; and a selecting portion configured to cause an operator to select one of a plurality of modes when the plurality of jobs in which a plurality of numbers of times of replacement of the fixing portions is needed on the basis of a determination result of the determining portion are successively reserved, the plurality of modes including a first mode in which execution order is changed so as to decrease a number of times of replacement of the fixing portions and then the plurality of jobs are executed in the changed execution order and a second mode in which the plurality of jobs are executed in reserved order.

According to further aspect of the present invention, there is provided an image forming apparatus comprising: an image forming portion configured to form a toner image on a recording material to execute a job; a fixing portion configured to fix, on the recording material, the toner image formed by the image forming portion, the fixing portion being capable of being replaced with another fixing portion depending on a content of the job; and an executing portion configured to execute one of a plurality of modes when a plurality of jobs are successively reserved, the plurality of modes including a first mode in which execution order is changed so as to decrease a number of times of replacement of the fixing portion and then the plurality of jobs are executed in the changed execution order and a second mode in which the plurality of jobs are executed in reserved order.

Further features of the present invention will become apparent from the following description of exemplary embodiments with reference to the attached drawings.

DESCRIPTION OF THE EMBODIMENTS

The present invention will be described specifically based on Embodiments with reference to the drawings. Incidentally, the following embodiments are examples of preferred embodiments of the present invention, but the present invention is not limited only thereto.

[Embodiment]

(1) Image Forming Apparatus

Figure 5:
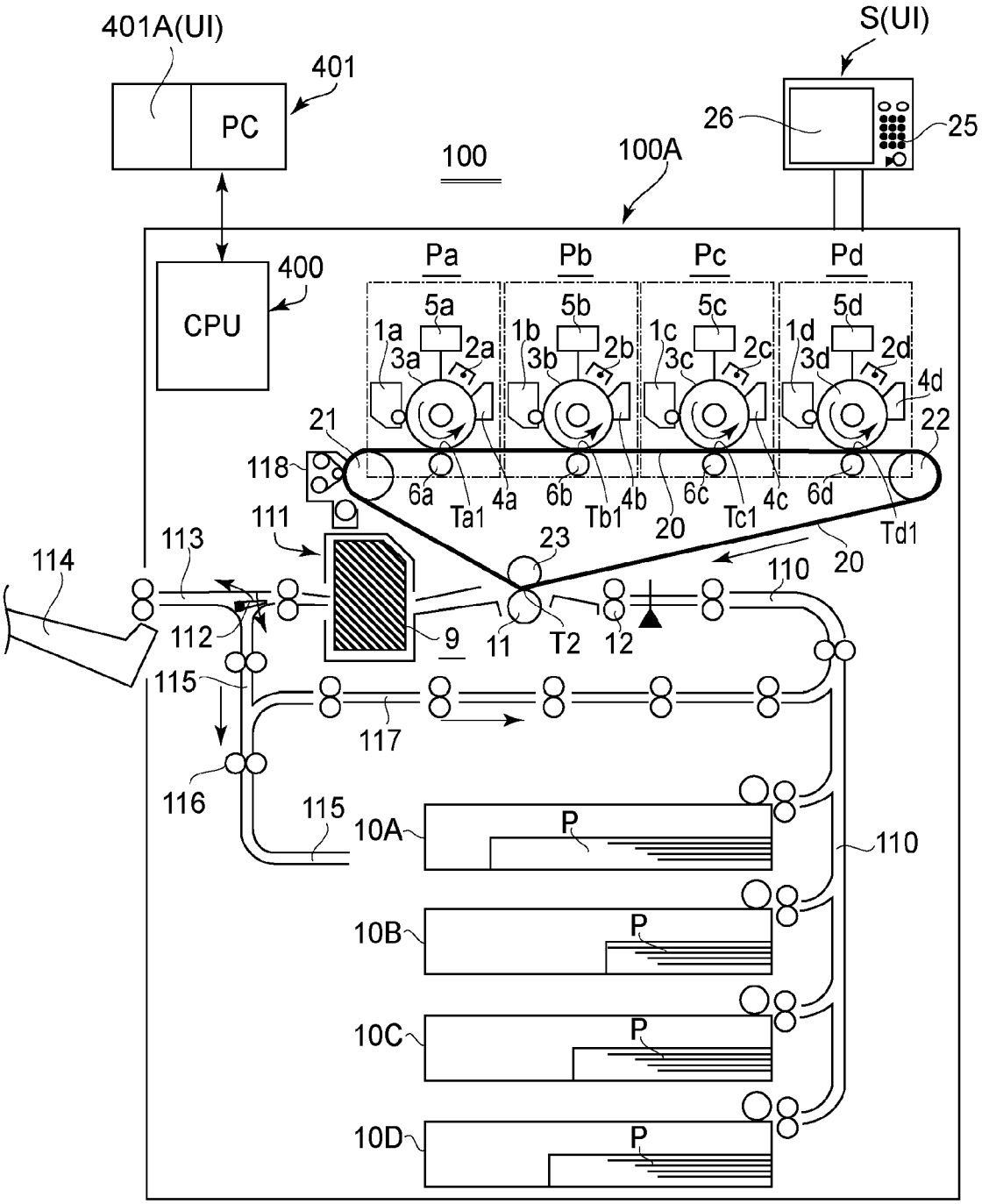
FIG. 5 is a schematic structural view of an example of the image forming apparatus.
Figure 6:
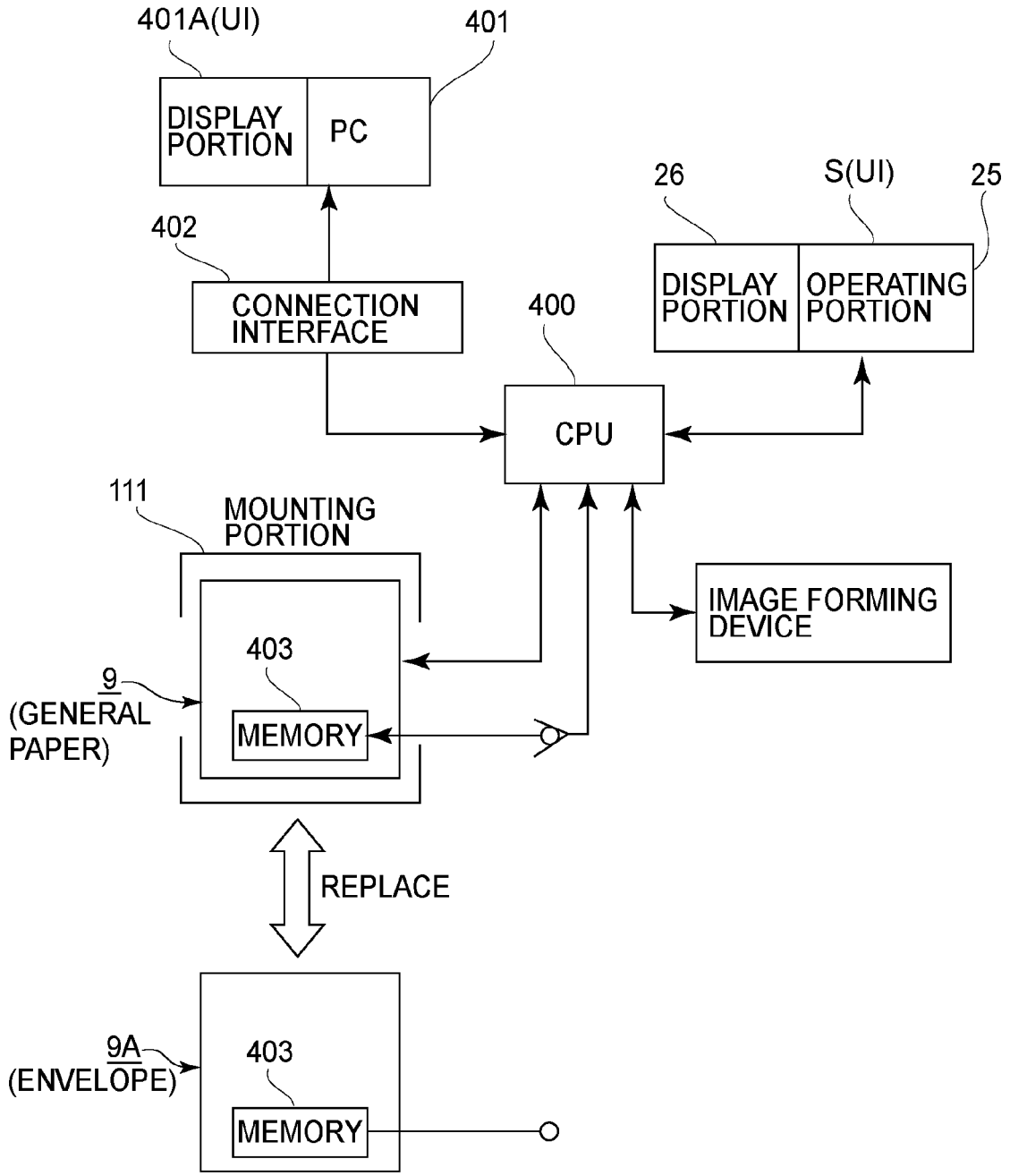
FIG. 6 is a rough block diagram of a control system.

FIG. 5 is a schematic structural view of an image forming apparatus 100 in this embodiment, and FIG. 6 is a rough block diagram of a control system. This image forming apparatus 100 is an electrophotographic laser beam printer capable of forming a full-color image or a monochromatic image on a recording material P. That is, a job in which image data and recording material information inputted from a PC (personal computer) 401 connected with a CPU (controller) 400 via an operating portion (UI (user interface)) S or a connection interface 402 are added is inputted. An image forming operation corresponding to the inputted job is performed, so that an image-formed product is printed and outputted.

The recording material P is a sheet-like recording material (medium) on which a toner image is capable of being formed. Examples of the recording material P may include regular-sized or irregular-sized papers, such as plain paper, thin paper, thick paper, high-quality paper, coated paper, an envelope, a postcard, a seal, a resin sheet, an OHP sheet, printing paper, format paper, and the like. Hereinafter, the recording material is referred to as a sheet. For convenience, treatment of the recording material (sheet) P will be described using terms, relating to the paper (sheet), such as sheet passing, sheet feeding, sheet discharge, a sheet-passing portion and non-sheet-passing portion, but the recording material is not limited to the paper.

The job (image forming job) refers to an image forming instruction in which printing condition information, such as image data, species of designated sheet P, a basis weight, a sheet size, the number of sheets, the number of copies, a layout, and a post-process is added.

In an apparatus main assembly 100A of the image forming apparatus 100, four image forming portions Pa, Pb, Pc, Pd, for forming toner images of four colors consisting of yellow (Y), magenta (M), and cyan (C), which are three primary colors for subtractive color mixture, and black (K) are provided. Further, the image forming apparatus 100 includes an endless intermediary transfer belt (intermediary transfer member, hereinafter referred to as a belt) 20. The belt 20 is extended and stretched around rollers 21, 22, 23, and is rotationally driven in the clockwise direction indicated by an arrow.

The image forming portions Pa, Pb, Pc, Pd include drum-shaped electrophotographic photosensitive members (hereinafter referred to as drums) 3*a*, 3*b*, 3*c*, 3*d* as image bearing members, which are rotationally driven in the counterclockwise direction indicated by arrows and include image forming process means actable on the drums. In this embodiment, the image forming process means are chargers 2*a*, 2*b*, 2*c*, 2*d*, laser scanners 5*a*, 5*b*, 5*c*, 5*d*, developing devices 1*a*, 1*b*, 1*c*, 1*d*, primary transfer chargers 6*a*, 6*b*, 6*c*, 6*d*, and drum cleaners 4*a*, 4*b*, 4*c*, 4*d*.

A Y (yellow) toner image, an M (magenta) toner image, a C (cyan) toner image, and a K (black) toner image formed on the drums 3*a*, 3*b*, 3*c*, 3*d* are successively primary-transferred superposedly onto the belt 20 at primary transfer nips Ta1, Tb1, Tc1, Td1, respectively. Incidentally, an image forming process and operation at each of the image forming portions Pa, Pb, Pc, Pd are well known and therefore detailed description thereof will be omitted. A secondary transfer roller 11 is press-contacted to the belt 20 toward the roller 23, and forms a secondary transfer nip T2 between itself and the belt 20.

On the other hand, of sheet feeding cassettes 10A, 10B, 10C, 10D which are provided in multiple stages, a sheet feeding mechanism for the sheet feeding cassette in which the sheets P used in the job to be executed are accommodated is driven. As a result, one of the sheets P is separated and fed to pass through a sheet path 110, and thus is fed to a registration roller pair 12. The registration roller pair 12 feeds the sheet P to the secondary transfer nip T2 at predetermined control timing. As a result, the superposed toner images of the four colors of Y, M, C, K are collectively secondary-transferred from the belt 20 onto the sheet P.

The sheet P passed through the secondary transfer nip T2 is separated from the belt 20 and is introduced into a fixing apparatus (hereinafter referred to as a fixing device) 9. A surface of the belt 20 after separation of the sheet P is cleaned by a belt cleaner 118 and is repetitively subjected to image formation.

In this embodiment, the image forming portions Pa, Pb, Pc, Pd, the belt 20, the secondary transfer roller 11 and the sheet feeding mechanism constitute an image forming device for forming the toner images on the sheet (recording material) P.

The sheet P introduced into the fixing device 9 is subjected to heat-pressure fixing. The sheet P coming out of the fixing device 9 is induced toward a sheet discharging path 113 side by a flapper 112 and is discharged as a full-color image-formed product for one-side printing onto a sheet discharge tray 114 in the case of a one-side printing mode.

In the case of a double-side printing mode, the sheet P, which comes out of the fixing device 9 and which has already been subjected to printing on a first surface, is induced toward a reverse path 115 by the flapper 112, and is pulled and fed into the reverse path 115 by normal rotation of a reversing roller 116. Then, the sheet P pulled in the reverse path 115 in a predetermined manner is introduced into a path 117 for double-side printing by reverse rotation of the reversing roller 116, and then is introduced again into the secondary transfer nip T2 via the sheet path 110 in a state in which the sheet P is turned upside down. As a result, the formation of the toner image on a second surface of the sheet P is made.

Subsequently, similarly as in the case of the one-side printing mode, the sheet P is fed through the fixing device 9 and the sheet discharging path 113 and then is discharged as a double-side image-formed product onto the sheet discharge tray 114.

In the case of monochromatic (single-color) image formation, the image forming portion necessary to effect the image formation performs an image forming operation, and at the image forming portions other than the image forming portion, associated drums are only idled and the image forming operation is not performed.

The operating portion S not only provides an image formation start instruction but also can make image quality setting of the image and input of information on the sheets P set in the sheet feeding cassettes 10A-10D using operation keys 25 and a display portion 26.

The display portion 26 is a liquid crystal screen of a touch panel type, and by the CPU 400, display of various pieces of information (display of messages), such as a state of the image forming apparatus, error information, jam information, other information, and the like can be made. Further, at the display portion 26, display of various operation buttons (keys) is also made. The user can make designation of printing conditions (various settings) by using the operation buttons (keys) displayed at the display portion. The CPU 400 determines an image forming condition on the basis of the inputted information and effects image formation during image formation under a predetermined condition.

(2) Fixing Device

The fixing device (apparatus) 9 is replaceable with another fixing device at a predetermined mounting portion 111 in a predetermined procedure and a predetermined manner. That is, the image forming apparatus 100 is capable of effecting image formation in a state in which the fixing device 9 mounted is replaced with another fixing device 9A customized to a particular recording material. Each of the fixing devices 9, 9A operates by transmission of a driving force and electric power supply from the apparatus main assembly 100A side in a state in which the fixing device 9, 9A is mounted to the mounting portion 111 of the apparatus main assembly 100A in a predetermined manner. Further, the fixing device 9, 9A transfers various pieces of control information with the CPU 400. A driving mechanism, an electric power supplying mechanism, a communication mechanism and the like for that purpose were omitted from illustration in the figures.

The fixing device 9 is a general-purpose fixing device capable of fixing images on general recording materials, except for an envelope, for example, recording materials of a variety of species such as thin paper, plain paper, thick paper, coated paper and high-quality paper. Further, the fixing device 9A is an exclusive (dedicated) fixing device customized exclusively to the envelope. Incidentally, the plain paper is exceptionally usable for the fixing device 9A. In the following, in this embodiment, the fixing devices 9, 9A described above will be described specifically, but the following constitution may also be employed.

For example, as the exclusive fixing device 9A, an exclusive fixing device customized to a special (particular) recording material other than the envelope may be used.

Further, a constitution in which a structure of the fixing device 9 itself which is limited to a size of a usable recording material P may also be employed. That is, a constitution in which the fixing device 9 is a fixing device for an A4-sized sheet (i.e., use of a recording material of less than the A4 size is prohibited), and the fixing device 9A is a fixing device for an A5-sized sheet (i.e., use of a recording material of less than the A5 size is prohibited) may also be employed.

This is because for example in the case where the A4-sized sheets are successively passed through the fixing device 9, such a problem that a fixing member is damaged by contact with side edges of the sheets and uneven glossiness generates on the image after fixing due to the damage is suppressed (solved). For that reason, for example, in the fixing device 9 for the A4-sized sheet, passing of sheets of less than the A4 size is prohibited in principle. Accordingly, replacement of the fixing device 9 is required.

In this way, the fixing device 9 may need to be replaced not only due to the species of the recording material P, but also due to a width size of the recording material P.

Figure 7:
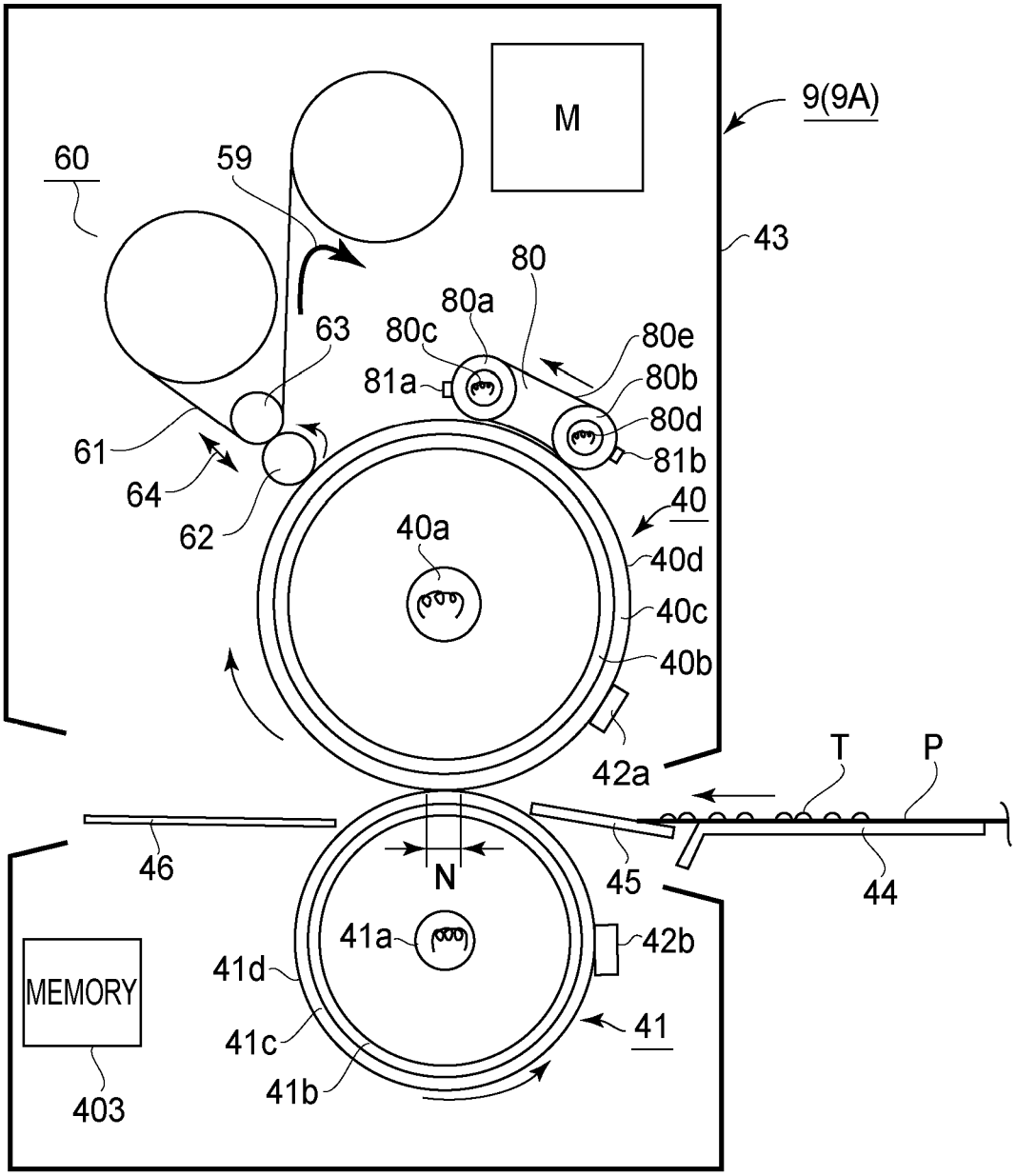
FIG. 7 is a schematic structural view of a fixing device.

FIG. 7 is a structural illustration used in this embodiment. This fixing device 9 (9A) is an image heating apparatus of a heat roller type. An unfixed toner image T secondary-transferred on the sheet P is nipped and fed by a heating nip (fixing nip) N formed by press-contact between a fixing roller (heat fixing member) 40 contacted to an image surface and a pressing roller (pressing heat member) 41 and is fixed on the sheet P. On an entrance side of the heating nip N, sheet guiding members 44, 45 are provided, and on an exit side of the heating nip N, a sheet guiding member 46 is provided.

That is, in this embodiment, the fixing device 9 (9A) includes a pair of rotatable members 40, 41 for fixing the toner image, formed on the sheet P (recording material) by heat and pressure.

The fixing device 9 is used as a general paper fixing device, and the pressing roller 41 is press-contacted to the fixing roller 40 at a total pressure of 784 N (about 80 kgf), so that the heating nip N is formed.

The fixing roller 40 is constituted so as to have a diameter of 80 mm by forming a 3 mm-thick elastic layer 40*c* on an outer peripheral surface of a core metal 40*b*, which is an aluminum mode cylinder. The elastic layer 40*c* is an HTV (high-temperature vulcanising) silicone rubber layer. An outer peripheral surface of the rubber (elastic) layer is coated with a tube, as a parting layer 40*d* to be contacted to the image surface, principally formed of a copolymer of tetrafluoroethylene and perfluoroalkoxyethylene (hereinafter referred to as PFA).

The pressing roller 41 is constituted so as to have a diameter of 60 mm by forming a 1 mm-thick elastic layer 41*c* on an outer peripheral surface of a core metal 41*b* which is an aluminum-mode cylinder. The elastic layer 40*c* is, similarly as in the fixing roller 40, an HTV silicone rubber layer. An outer peripheral surface of the rubber (elastic) layer is coated with a PFA tube as a parting layer 41*d*. An outer diameter shape of the pressing roller 41 is a reverse crown shape such that an outer diameter at end portions is larger than an outer diameter at a central portion with respect to a longitudinal direction by 40 μm At rotation centers of the fixing roller 40 and the pressing roller 41, halogen heaters 40*a* and 41*a* for heating the rollers 40 and 41, respectively, are provided non-rotationally. In this embodiment, as the halogen heater 40*a*, a heater of 200 W in normal rated power was used, and as the halogen heater 41*a*, a heater of 400 W in normal rated power was used. The halogen heaters 40*a* and 41*a* are ON/OFF-controlled by the CPU 400 so that surface temperatures of the respective rollers 40 and 41 are predetermined temperatures on the basis of output results of temperature detecting elements 42*a* and 42*b*, respectively, for detecting the surface temperatures of the rollers 40 and 41, respectively.

Further, each of the fixing roller 40 and the pressing roller 41 is supported at both ends thereof by a fixing device casing 43 via a ball bearing, and is rotatable. Gears (not shown) fixed to one ends of the fixing roller 40 and the pressing roller 41 are connected with each other by a gear mechanism, so that these rollers 40 and 41 are rotationally driven integrally with each other in arrow directions by a driving force of a driving system (not shown) on the apparatus main assembly 100A side.

As a cleaning mechanism 60 for the fixing roller 40, a collecting roller 62 of 20 mm in diameter is provided so as to rotate in contact with the surface of the fixing roller 40, and in the case where the toner remains on the surface of the fixing roller 40 during fixing, the toner is collected by the collecting roller 62.

The collecting roller 62 is a hollow roller of aluminum and is coated as a surface layer with tetrahedral amorphous carbon. This is because a parting property with the PFA tube 40*d* as the surface layer of the fixing roller 40 and ease of removal of the toner from the collecting roller 62 by cleaning are taken into consideration. That is, when the toner is collected from the fixing roller 40, the collecting roller 62 not only has a parting property lower than that of the PFA tube 40*d* as the surface layer of the fixing roller 40, but also is easily cleaned by a cleaning web 61, described later, by removing the toner.

Further, the cleaning web 61 and a web roller 63 for supporting the cleaning web 61 and for urging the cleaning web 61 toward the collecting roller 62 are movable in an arrow 64 direction by a mounting and demounting mechanism M operated and controlled by the CPU 400. That is, the mounting and demounting mechanism M is operated by an instruction from the CPU 400 to effect mounting and demounting, and in a mounted state, the cleaning web 61 is urged against the collecting roller 62 with a force of about 40 N, so that the toner which is collected from the fixing roller 40 and which remains on the collecting roller 62 is removed by the cleaning web 61. The cleaning web 61 contacting the collecting roller 62 is wound up and fed in an arrow 59 direction, so that the surface thereof contacting the collecting roller 62 is always supplied (renewed) as a fresh surface where no toner is deposited.

The collecting roller 62 is supported by a ball bearing supported movably in a direction toward the fixing roller 40 and is rotatable. The collecting roller 62 is always contacted to the fixing roller 40, and in a non-contact state of the cleaning web 61, the collecting roller 62 is urged against the fixing roller 40 with an urging force of about 10 N by its own weight, so that a driving force is transmitted from the fixing roller 40 to the collecting roller 62, and thus the collecting roller 62 is rotated by rotation of the fixing roller 40. In a contact state of the cleaning web 61, the collecting roller 62 is urged against the fixing roller 40 with a force of about 50 N obtained by adding an urging force of 40 N to the above urging force of about 10 N, so that the driving force is transmitted from the fixing roller 40 to the collecting roller 62, and thus the collecting roller 62 is rotated by rotation of the fixing roller 40.

An external heating device 80 is constituted by two external heating and supporting rollers 80*a*, 80*b* and an external heating belt 80*e*. The external heating device 80 is used for replenishing a heat quantity corresponding to an insufficient amount of supply by the heater 40*a* inside the fixing roller 40, and the heater 41*a* inside the pressing roller 41 relative to heat taken from the heating nip N by the sheet P, and has the function of maintaining a surface temperature of the fixing roller 40 at a predetermined temperature or more. The external heating belt 80*e* is provided for forming a broad nip with the fixing roller 40 thereby to increase a heat transfer amount.

Further, the external heating device 80 is detachably mountable by a mounting and demounting mechanism (not shown), and the CPU 400 controls the mounting and demounting mechanism, so that the external heating device 80 can be arbitrarily mounted to and demounted from the fixing roller 40. The driving force is transmitted from the fixing roller 40 to the external heating device 80 only when the external heating and supporting rollers 80*a*, 80*b* and the external heating belt 80*e* are urged in a state in which the external heating belt 80*e* is contacted to the fixing roller 40, so that the external heating belt 80*e* is rotated in an arrow direction.

The external heating and supporting rollers 80*a*, 80*b* are supported at both ends thereof by ball bearings and are rotatable, and at rotation centers thereof, halogen heaters 80*c*, 80*d* for heating the rollers 80*a*, 80*b*, respectively, are provided non-rotationally. In this embodiment, as the halogen heaters 80*c*, 80*d*, a heater of 1500 W in normal rated power was used.

When the external heating belt 80*e* is at rest, the halogen heaters 80*c*, 80*d* are ON/OFF-controlled by the CPU 400 so that a surface temperature of the belt 80*e* is a predetermined temperature on the basis of output results of temperature detecting elements 81*a*, 81*b*, respectively.

When the external heating device 80 is in a contact state with the fixing roller 40 and the external heating belt 80*e* starts rotation by the driving force from the fixing roller 40, the CPU 400 effects the following control. That is, the CPU 400 effects ON/OFF control of the halogen heaters 80*c*, 80*d* depending on an output value of only the temperature detecting element 81*a* positioned upstream of a nip formed by the external heating belt 80*e* and the fixing roller 40 with respect to the rotational direction of the external heating belt 80*e*. However, the CPU 400 always continuously monitors also an output of the temperature detecting element 81*b*.

In the fixing device 9, a memory (nonvolatile memory) 403 as a discriminating portion indicating information (discrimination information corresponding to the species of the recording material for the fixing device customized to a particular recording material) on the type (species) of the fixing device is mounted. The information on the type of the fixing device is information for discriminating whether the fixing device is the general-purpose fixing device using a normal sheet or the exclusive fixing device customized to the envelope or special paper.

In the memory 403, the information on the fixing device type (species) is stored in advance, and the CPU 400 (controller) reads the information in the memory 403 of the mounted fixing device as desired. The CPU 400 includes an acquiring portion (acquisition function portion) for acquiring the discrimination information indicated by the discriminating portion 403 of the fixing device mounted in the image forming apparatus 100.

Incidentally, the discriminating portion 403 provided in the fixing device 9 is not limited to the memory 403. The discriminating portion 403 may only be required such that the information can be acquired by the acquiring portion, and may also be mechanically constituted by a micro-switch or a dip switch. Specifically, for example, a constitution such that discrimination is made depending on whether or not an amount of electrical contacts out of ten electrical contacts are electrically continuous (or whether or not electrical contacts at particular positions are electrically continuous) may also be employed.

For the image forming apparatus 100 in this embodiment, when the above-described fixing device 9 is the general-purpose fixing device, separately from the fixing device 9, another fixing device (for the envelope) 9A is prepared as a fixing device exclusively for the envelope. A constitution of the fixing device 9A exclusively for the envelope is the same as the constitution of the above-described general-purpose fixing device 9 shown in FIG. 7. However, as shown in Table 1 below, a total pressure for causing the pressing roller 41 to be press-contacted to the fixing roller 40 is 588 N (about 60 kgf), and a reverse-crown amount of an outer diameter shape of the pressing roller 41 is 150 μm.

This is because in contrast to general cut paper (general-purpose paper), the envelope is in a bag shape such that the paper is superposed, and therefore creases are liable to generate and in order to eliminate the crease, there was a need to increase the reverse-crown amount. Further, at a portion where a degree of overlapping is large, for example, at a flap portion, pressure in the nip is high only thereat, and therefore a difference in glossiness of the toner image generates, so that there was a need that the pressure for the press-contact of the pressing roller 41 is reduced and the difference in glossiness is not readily generated.

TABLE 1

| Type*1 | UF+2 (N) | RAC*3 (μm) |
|---|---|---|
| FGPP*4 | 784 | 40 |
| FE*5 | 588 | 150 |

*1"Type" is the type (species) of the fixing device.
*2"UF" is the urging force.
*3"RCA" is the reverse-crown amount of the pressing roller.
*3"FGPP" is for the general-purpose paper.
*5"FE" is for the envelope.

When the envelope is to be passed through the fixing device, the fixing device 9A for the envelope is exchanged (replaced) for the general purpose fixing device 9 by the user therewith. The CPU 400 controls an operation (the pressure of the fixing device, a feeding speed of the sheet and the like) of the image forming apparatus 100 on the basis of the fixing device discrimination information acquired from the discriminating portion 403 of the fixing device mounted in the image forming apparatus 100.

(3) Selection of Print Preferential Order Mode

Figure 1:
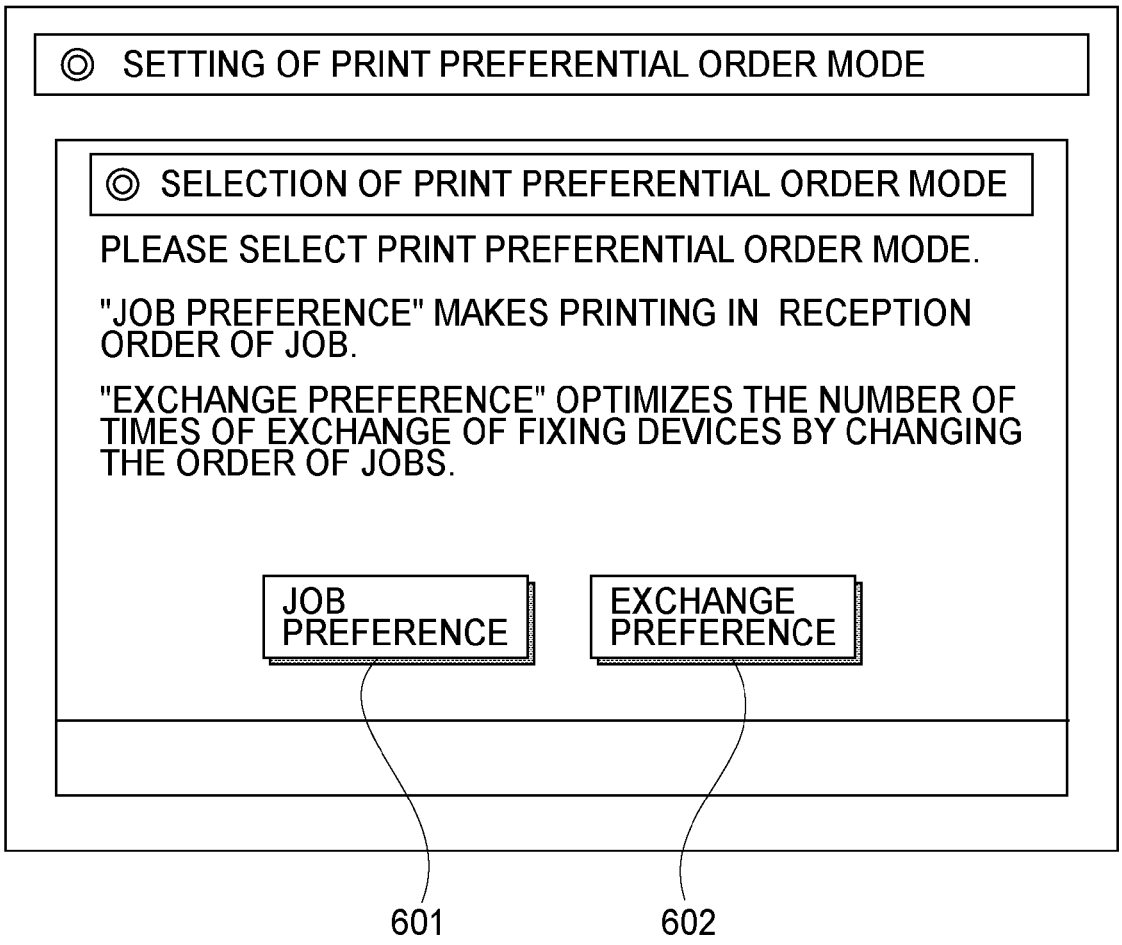
FIG. 1 is an illustration showing an example of a selected screen displayed at a display portion of an operating portion.

The user can display a "print preferential order mode" screen, as shown in FIG. 1, by operating the operating portion S of the image forming apparatus 100. Using this screen, the user is capable of selecting a "job preferential mode" and an "exchange preferential mode" in advance. At this time, the CPU 400 (display controller) controls display contents of the display portion (liquid crystal screen) 26 of the operating portion S, thus causing the liquid crystal screen 26 to display the screen shown in FIG. 1.

The job preferential mode is the print preferential order mode in which printing is made in reception order of jobs. That is, even in the case where replacement of the fixing device is required to be made plural times in a process of executing a series of a plurality of image forming jobs for forming images on a plurality of different species of sheets, an operation is executed in the job reception order.

The exchange preferential mode is the print preferential order mode in which the number of times of exchange of the fixing device is optimized by replacing the order of jobs. That is, in the case where the replacement or exchange of the fixing device is required to be made multiple times in the process of executing the series of the plurality of image forming jobs for forming the images on the plurality of different species of sheets, the order of the series of the plurality of image forming jobs is changed in order to decrease the number of times of exchange of the fixing device.

When the user presses a job preference button (key) 601, thus selects the job preferential mode, the CPU 400 effects the image formation as in reservation order of the plurality of jobs which are successively reserved (received). On the other hand, when the user presses an exchange preference button (key) 602, and thus selects the exchange preferential mode, the CPU 400 replaces the order of jobs so that the number of times of the exchange of the fixing device becomes small.

Figure 2:
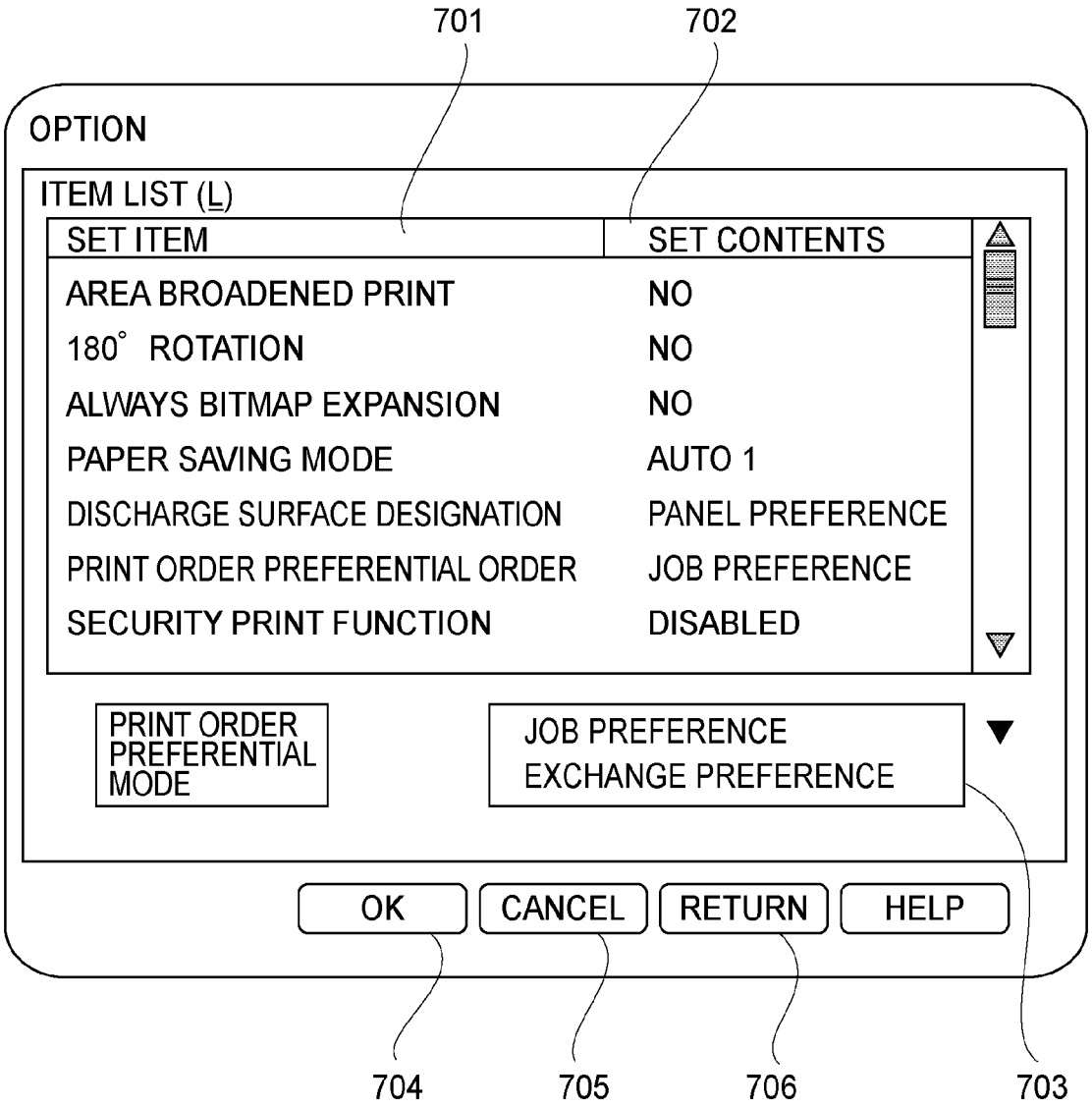
FIG. 2 is an illustration showing an example of a selected screen displayed at a display portion of a PC.

Incidentally, setting of the mode is capable of being made through a host computer (PC) 401 connected with the image forming apparatus 100 via a LAN cable. FIG. 2 is a setting screen (printer driver) displayed on a monitor 401A connected with the PC 401. The CPU 400 controls a subsequent image forming operation depending on information on the mode selected in the setting screen shown in FIG. 2.

In the case where the user wishes to change the setting, when the user selects an associated item from set items 701, options (choices) for the associated item are displayed in a pull-down menu 703. In this case, a state in which the options consisting of the "job preferential mode" and the "exchange preferential mode" are displayed is shown.

When the user selects a desired one of the options, selection results are displayed on set contents 702. Thereafter, when the user presses an OK button 704, a set result is sent from the PC 401 to the CPU 400 of the image forming apparatus 100 via the connection interface 402. Further, when the user does not press the OK button 704, but presses a cancel button 705, selected setting is not sent to the CPU 400 of the image forming apparatus 100, and the setting screen of FIG. 2 disappears.

A button 706 for returning the setting to a default setting is a button for returning the setting to an initial setting, and thus returns all of the items displayed in the set items 701 to initially set items. Thereafter, when the OK button 704 is pressed, the initial setting is sent to the CPU 400 of the image forming apparatus 100.

The functions described above can properly be used in the case where the image formation is intended to be effected as in the job reservation order, and in the case where an image formation time is intended to be shortened by exchanging the fixing device fewer times, depending on a status of use by the user.

(4) Operation Control of Image Forming Apparatus

Figure 3A:
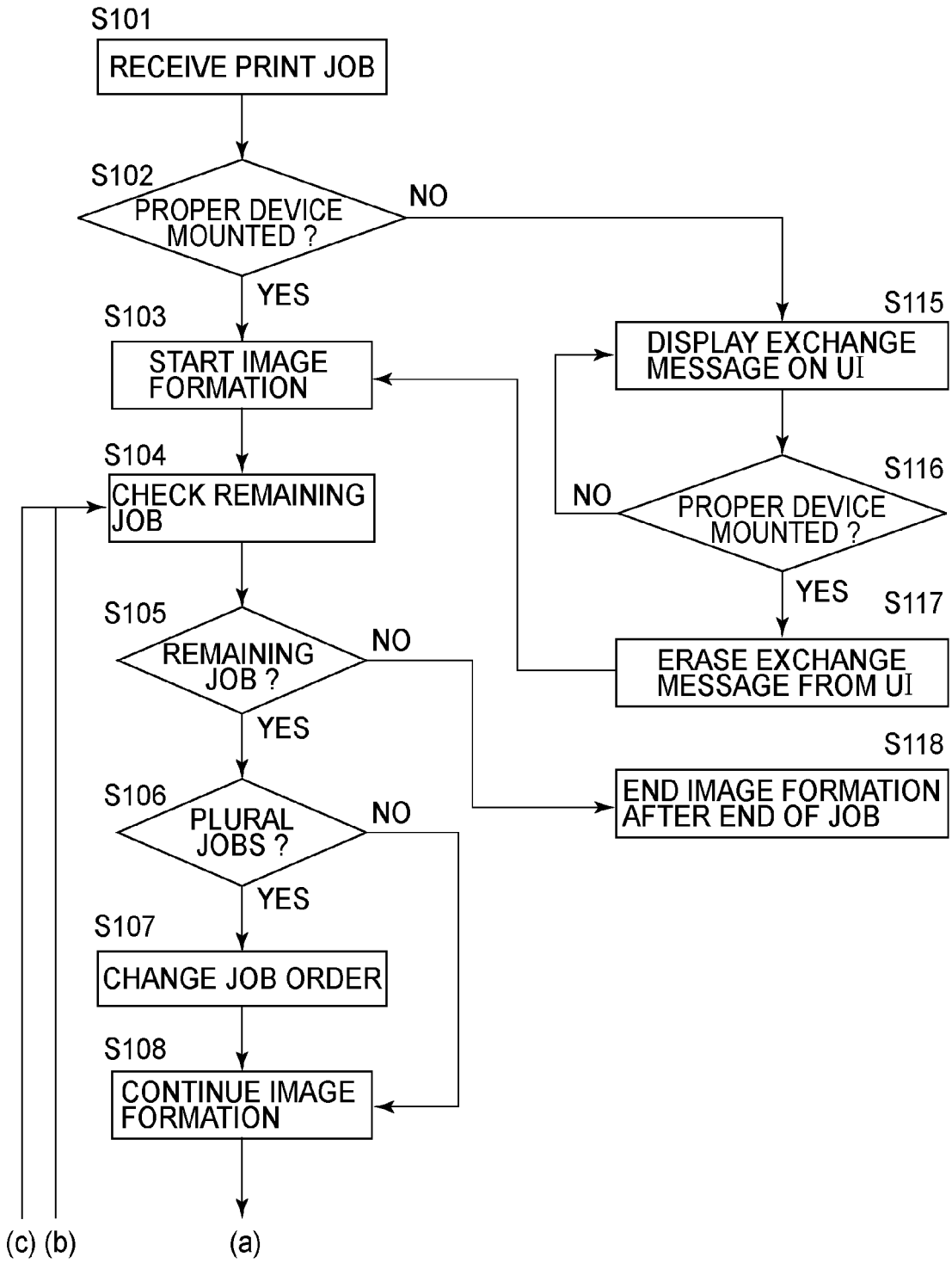
FIG. 3A is a part of a flowchart showing an operation of an image forming apparatus.
Figure 3B:
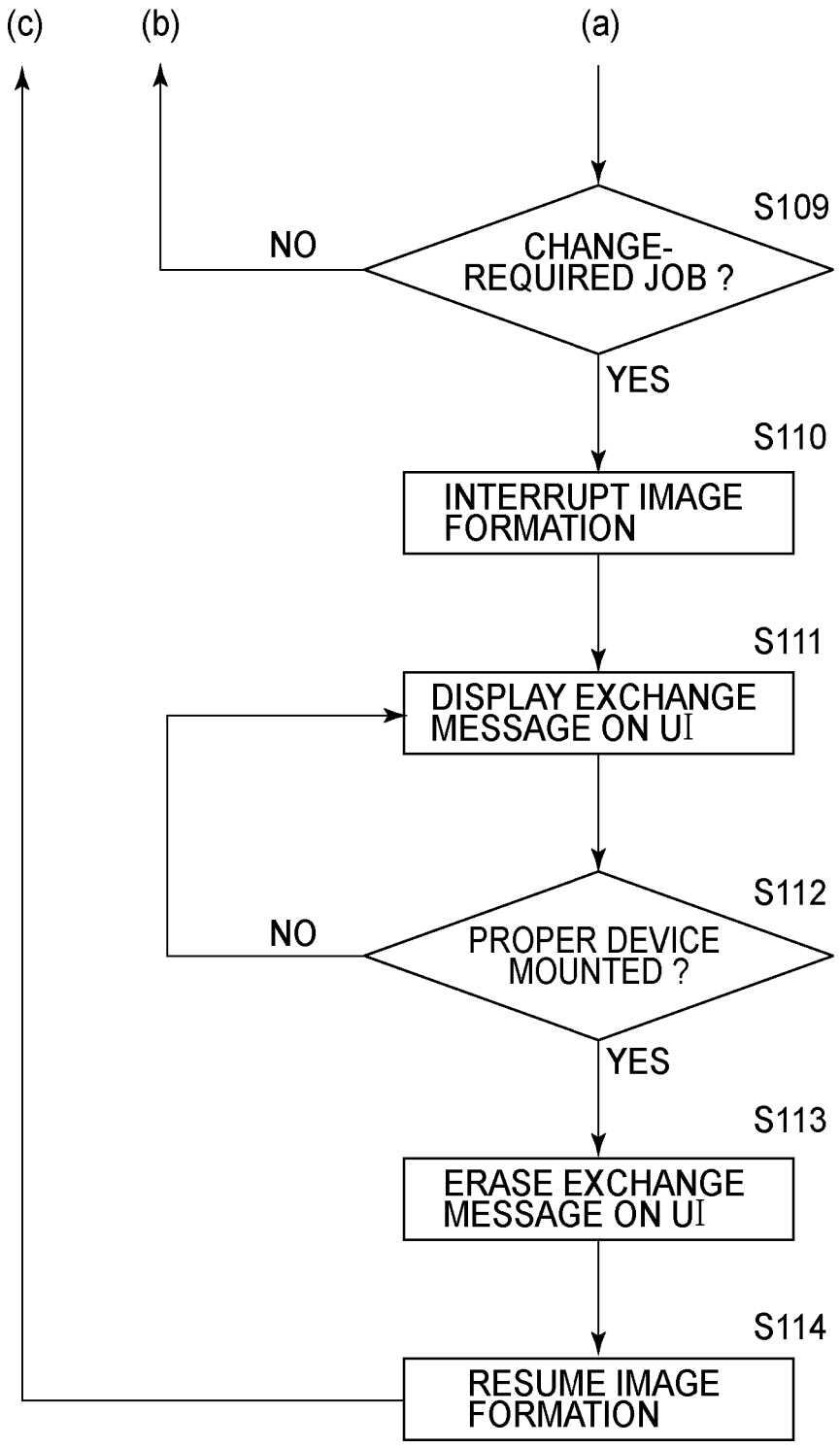
FIG. 3B is a remaining part of the flowchart showing the operation of the image forming apparatus.

FIGS. 3A and 3B are a flowchart showing control and an operation of the image forming apparatus 100 from a start to an end of an image forming operation in the case where the exchange preferential mode is selected in advance. This control flow is executed by controlling various devices by the CPU 400 (executing portion).

A printing job (image forming job) to which image data and recording material information are added is sent to the CPU 400 from the operating portion S or from the PC 401 or the like connected to the CPU 400 via the connection interface 402 (S101).

Then, first, the CPU 400 makes determination as to whether or not the fixing device 9 currently mounted is suitable for sheets subjected to image formation corresponding to the job on the basis of the recording material (sheet) information added to the job (S102).

That is, the CPU 400 reads fixing device type information (discrimination information) stored in advance in the memory 403 as a discriminating portion mounted in the currently mounted fixing device 9. The CPU 400 checks the read discrimination information against the sheet information added to the job, and determines whether or not the sheet information of the job and the fixing device adapt to each other.

In the case where the sheet information of the job and the fixing device 9 do not adapt to each other, a message (fixing device replacement message) for urging the user to exchange (replace) the fixing device 9 is displayed on the display portion 26 of the operating portion (UI) S or on a screen of the monitor 401A connected with the PC 400 (S115). Then, the image forming apparatus 100 is in stand-by until the fixing device 9 suitable for the job is mounted (S116).

The CPU 400 determines whether or not the replaced fixing device 9 adapts to the job by checking the fixing device type discrimination information acquired from the memory 403 of the replaced fixing device 9 against the sheet information added to the job. When the replaced fixing device 9 adapts to the job, the message for urging the user to exchange the fixing device 9 is erased (S117). When adaptation of the fixing device type discrimination information to the sheet information added to the job can be confirmed, the image forming operation is started (S103).

Simultaneously with the image formation, it is determined whether or not a job (remaining job), subsequent to the job in which the image forming operation is currently performed, exists (i.e., the remaining job is received) (S104, S105). When there is no remaining job, the image forming operation is ended upon completion of the job currently operated (S118).

In the case where there are remaining jobs, on the basis of pieces of the sheet information added to the jobs, whether or not exchange of the fixing device has occurred multiple times is discriminated (S106). In the case where the remaining job does not require the exchange of the fixing device 9 or is a single job, the image formation is continued as it is (S108).

In the case where exchange of the fixing device 9 is required multiple times, the execution order of the image forming job is changed so that the job using the same fixing device 9 as the fixing device 9 used in the current job is given preference (S107).

Figure 4:
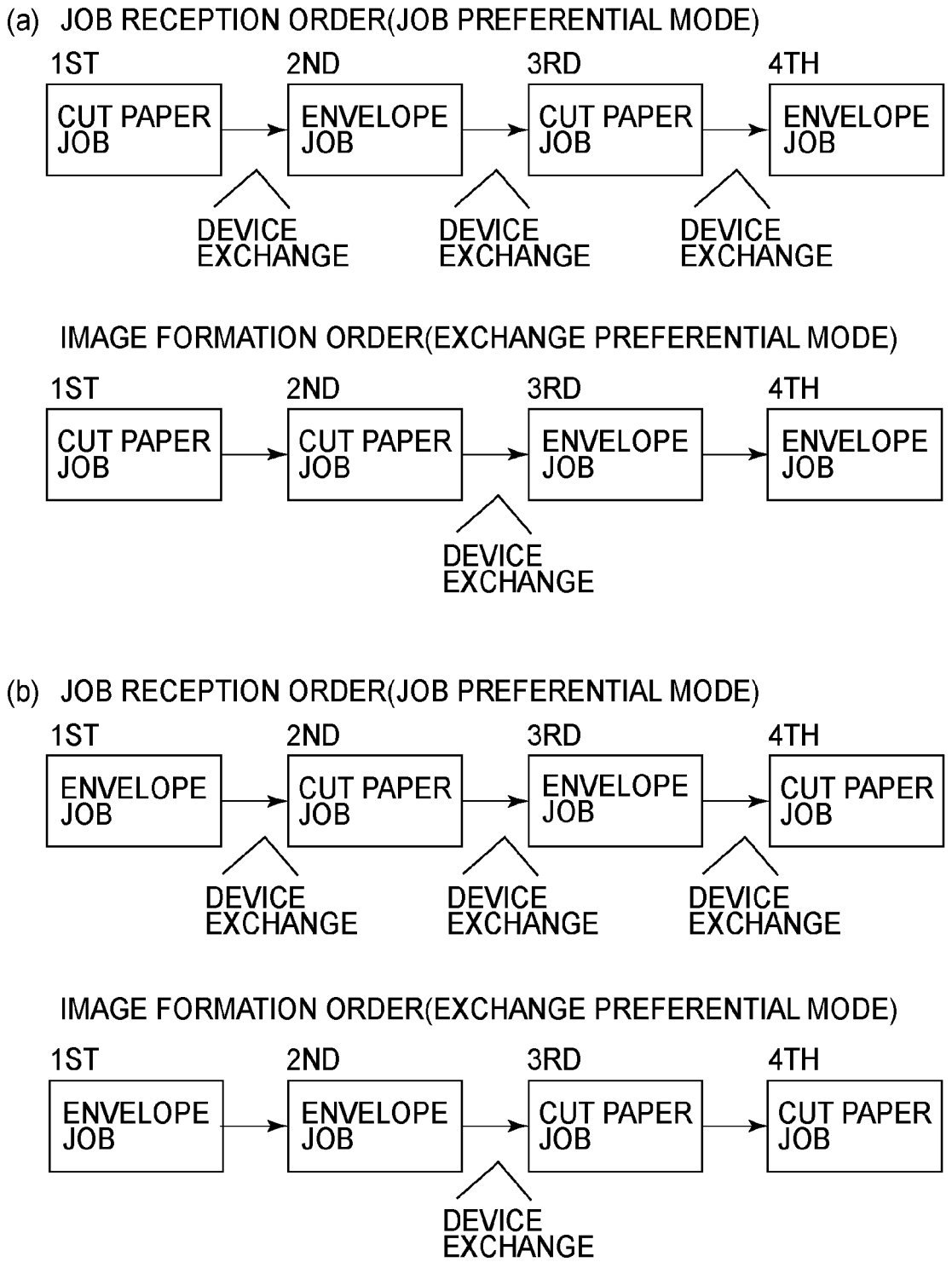
In FIG. 4, (a) and (b) are illustrations each showing an execution order of an image forming job.

In FIG. 4, (a) shows an example of job replacement in the case where a job for cut paper (plain paper) and a job for the envelope are input alternately. In the case where the job preferential mode shown on an upper side is selected, the image formation is effected in job reception order (reservation order). In this case, three times of a fixing device exchange operation generates. That is, the CPU 400 (determining portion) determines the number of times of the fixing device replacement required in a process in which the plurality of jobs successively reserved are executed. The example on the upper side of (a) of FIG. 4 is the case where the multiple replacement of the fixing device replacement is needed.

On the other hand, in the case where the operation mode is designated to the exchange preferential mode, shown on a lower side of (a) of FIG. 4, by the determination in S106, the execution order of the jobs is changed so that the cut paper job takes preference over the envelope job. Then, the image formation is continued until the CPU 400 determines whether or not the job remaining is the job requiring the fixing device exchange (S108, S109).

When the image forming operation order reaches timing of the job requiring change of the fixing device 9, the image forming operation is interrupted (S110). Then, the CPU 400 causes the display portion 26 of the operating portion S, or the display portion 401A of the PC 401, to display the message for urging the user to exchange (replace) the fixing device 9 on the screen, and the image forming apparatus 100 is in stand-by until the fixing device 9A, for example, adapting to the job is mounted (S111, S112).

The CPU 400 determines whether or not the replaced fixing device 9 adapts to the job by checking the fixing device 9 type information acquired from the memory 403 of the replaced fixing device 9 against the sheet information added to the job. When the replaced fixing device 9 adapts to the job, the exchange urging message is erased (S113). In this way, when the adaptation of the fixing device 9 to the sheet for the job can be confirmed, the image forming operation is resumed (S114).

The above operation is continued as long as the job remains, and when there is no subsequent job, the image forming operation is ended (S118).

Further, also in the case of an example shown in (b) of FIG. 4, similarly as in (a) of FIG. 4, the execution order of reserved four jobs is controlled by the CPU 400 depending on whether the case in which the job preferential mode is selected (the case where the number of times of replacement is three (times)) or the case in which the exchange preferential mode is selected (the case in which the number of times of replacement is one (time)).

Incidentally, not only in the examples shown in (a) and (b) of FIG. 4, but also in the case where the plurality of jobs successively reserved are intended to be executed in the reservation order, the present invention is effective in the case where the fixing device replacement is required to be performed a plurality of times. That is, the number of jobs successively reserved is not limited to four, but may also be five or more or may also be three.

With respect to feeding of the sheets P from the sheet feeding cassettes 10A to 10D, the CPU 400 drives a feeding mechanism for the selected feeding cassette 10A to 10D, disposed at a stage where the sheets P corresponding to the sheet information added to the job to be executed are accommodated, so that the sheets P are separated and fed one by one, and the image formation is executed. When absence of the sheet in the sheet feeding cassette 10A to 10D is detected by a sensor (not shown) during execution of a continuous image forming operation, the CPU 400 interrupts the image forming operation and causes the display portion 26 of the operating portion S, or the monitor 401A connected with the PC 401, to display a message on the screen urging the user to replenish the sheets. When the replenishment of the sheets is detected by the sensor, the image forming operation is resumed.

Further, the CPU 400 effects the following control, in the case where no accommodation of the sheet P, corresponding to the sheet information added to the job in the sheet feeding cassettes 10A to 10D at all of the stages, is detected by the sensor when the job is inputted or during execution of the job. That is, on the screen of the display portion 26 of the operating portion S or the monitor 401A connected with the PC 401, a message urging the user to replace the sheets in the sheet feeding cassette(s) 10A to 10D at any (one) of the stages with the sheets corresponding to the sheet information added to the job is displayed. When execution of the replacement of the sheets is detected by the sensor, the job is executed.

As described above, in the image forming apparatus 100 in which the plurality of fixing devices 9 are exchanged and used depending on the species of the sheets P, as in this embodiment, the image formation order of the jobs is changed so that the number of times of exchange of the fixing device 9 is reduced. That is, in the case where a series of a plurality of image forming jobs for forming images on a plurality of sheets P in species is executed, the CPU 400 changes the execution order of the plurality of image forming jobs depending on the discrimination information acquired by the acquiring portion for the mounted fixing device 9.

As a result, a waiting time due to the fixing device exchange and the number of times of an exchanging operation were able to be reduced, so that it was possible to alleviate a load on the user. As a specific example, in the jobs inputted in the order as shown on the upper side of (a) of FIG. 4, when the image formation order is not changed, three times of the fixing device exchange are required until the image formation is ended. However, as shown on the lower side of (a) of FIG. 4, by changing the image formation order, the series of image forming operations is ended by the single fixing device exchange.

In the above, as an embodiment to which the present invention is applied, the above-mentioned embodiment was described, but within the scope of the idea of the present invention, various constitutions can be replaced with other constitutions.

For example, the image forming apparatus is not limited to the color image forming apparatus, but may also be a monochromatic (single color) image forming apparatus for forming a monochromatic image.

For example, the fixing device 9 (9A) is not limited to the device for heating and fixing the unfixed toner image formed on the recording material. The fixing device 9 (9A) also encompasses a device used also as a treatment for adjusting surface glossiness of an image by re-heating the toner image, which is partly fixed or which has already been fixed (also in this case, the device is called the fixing device).

For example, the fixing device 9 (9A) may also employ a device constitution using a flexible endless belt as either one or both of the fixing member 40 and the pressing member 41. Further, the heating mechanisms for the fixing member 40 and the pressing member 41 are not limited to the halogen heater 40*a* and 41*a*, but can also have a constitution appropriately employing another heating mechanism of a ceramic heater type, an electromagnetic induction heating type, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-095640 filed on May 8, 2015, and 2016-040917 filed on Mar. 3, 2016, which are hereby incorporated by reference herein in their entirety.

What is claimed is:

1. An image forming apparatus comprising:

an input portion into which a job is to be input;

an image forming portion configured to form a toner image on a recording material to execute the job input into said input portion;

a fixing portion configured to fix, on the recording material, the toner image formed by said image forming portion, said fixing portion being capable of being replaced with another fixing portion depending on a content of the job;

a selecting portion configured to prompt an operator to select one of a plurality of modes before a plurality of jobs are successively reserved, the plurality of modes including a first mode, in which an execution order of the plurality of jobs is changed so as to decrease a number of times of replacement of said fixing portion when the plurality of jobs are successively reserved, and a second mode, in which the execution order of the plurality of jobs is not changed when the plurality of jobs are successively reserved; and a controller configured to control the execution order of the reserved jobs, wherein, in a case that the first mode is selected by the operator in said selecting portion, depending on successive reservation of the plurality of jobs input into said input portion, said controller changes the execution order of the plurality of jobs so as to decrease the number of times of replacement of said fixing portion, and in a case that the second mode is selected by the operator in said selecting portion, when the plurality of jobs are successively reserved, said controller maintains the execution order of the plurality of jobs in a reserved order.

2. The image forming apparatus according to claim 1, wherein when the first mode is selected by the operator in said selecting portion, said controller changes the execution order of the plurality of jobs so that the job using said fixing portion mounted in said image forming apparatus is given preference.

3. An image forming apparatus comprising:

an input portion into which a job is to be input;

an image forming portion configured to form a toner image on a recording material to execute the job input into said input portion;

a fixing portion configured to fix, on the recording material, the toner image formed by said image forming portion;

a mounting portion configured to selectively mount one of a plurality of types of fixing portions, including a first fixing portion capable of fixing the toner image on the recording material of a first predetermined type not including a predetermined envelope, and a second fixing portion capable of fixing the toner image on the recording material of a second predetermined type including the predetermined envelope;

a selecting portion configured to prompt an operator to select one of a plurality of modes before a first job using said first fixing portion, a second job using said second fixing portion, and a third job using said first fixing portion are successively reserved, the plurality of modes including a first mode, in which, when the first job, the second job, and the third job are successively reserved in said input portion during execution of a job using said first fixing portion, an execution order of the reserved jobs is changed, and a second mode, in which, when the first job, the second job, and the third job are successively reserved in said input portion, the execution order of the reserved jobs is not changed; and a controller configured to control the execution order of the reserved jobs, wherein, in a case that the first mode is selected by the operator in said selecting portion, depending on successive reservation of the first job, the second job, and the third job in said input portion, during execution of the job using said first fixing portion, said controller changes the execution order of the reserved jobs so as to be executed in order of the first job, the third job, and the second job, and in a case that the second mode is selected by the operator in said selecting portion, when the first job, the second job, and the third job are successively reserved in said input portion, said controller maintains the execution order of the reserved jobs in order of the first job, the second job, and the third job.

4. An image forming apparatus comprising:

an input portion into which a job is to be input;

an image forming portion configured to form a toner image on a recording material to execute the job input into said input portion;

a fixing portion configured to fix, on the recording material, the toner image formed by said image forming portion;

a mounting portion configured to selectively mount one of a plurality of types of fixing portions, including a first fixing portion capable of fixing the toner image on a recording material of a first predetermined type including a first recording material, and a second fixing portion capable of fixing the toner image on a recording material of a second predetermined type not including the first recording material;

a selecting portion configured to cause an operator to select one of a plurality of modes before each of a plurality of jobs, in which replacement of said fixing portion is needed a number of times, are successively reserved, the plurality of modes including a first mode, in which an execution order of the plurality of jobs is changed so as to decrease the number of times of replacement of said fixing portions when the plurality of jobs are successively reserved, and a second mode in which the execution order of the plurality of jobs is not changed when the plurality of jobs are successively reserved; and a controller configured to control the execution order of the reserved jobs, wherein, in a case that the first mode is selected by the operator in said selecting portion, depending on successive reservation of the plurality of jobs input into said input portion, said controller discriminates the number of times of replacement of said fixing portion in a process in which the plurality of jobs are executed, and changes the execution order of the plurality of jobs when a discrimination result indicates that the number of times that replacement of said fixing portion is needed is a plurality of times, and in a case that the second mode is selected by the operator in said selecting portion, when the plurality of jobs are successively reserved in said input portion, said controller maintains the execution order of the plurality of jobs in a reserved order.

5. An image forming apparatus comprising:

an input portion into which a job is to be input;

an image forming portion configured to form a toner image on a recording material to execute the job input into said input portion;

a fixing portion configured to fix, on the recording material, the toner image formed by said image forming portion, said fixing portion being capable of being replaced with another fixing portion depending on a content of the job;

a receiving portion configured to receive information corresponding to one of a plurality of modes selected by an operator before a plurality of jobs are successively reserved, the plurality of modes including a first mode, in which an execution order of the plurality of jobs is changed so as to decrease a number of times of replacement of said fixing portion when the plurality of jobs are successively reserved, and a second mode in which the execution order of the plurality of jobs is not changed when the plurality of jobs are successively reserved; and a controller configured to control the execution order of the reserved jobs, wherein, in a case that the information received by said receiving portion corresponds to the first mode, depending on successive reservation of the plurality of jobs input into said input portion, said controller changes the execution order of the plurality of jobs so as to decrease the number of times of replacement of said fixing portion, and in a case that the information received by said receiving portion corresponds to the second mode, when the plurality of jobs are successively reserved, said controller maintains the execution order of the plurality of jobs in a reserved order.

6. An image forming apparatus comprising:

an image forming portion configured to form a toner image on a recording material to execute a job;

a fixing portion configured to fix, on the recording material, the toner image formed by said image forming portion, said fixing portion being capable of being replaced with another fixing portion depending on a content of the job;

a selecting portion configured to prompt an operator to select one of a plurality of modes, the plurality of modes including a first mode, in which an execution order of a plurality of jobs is changed so as to decrease a number of times of replacement of said fixing portion when the plurality of jobs are successively reserved, and a second mode, in which the execution order of the plurality of jobs is not changed when the plurality of jobs are successively reserved; and a controller configured to control the execution order of the plurality of jobs reserved, according to the mode selected by the operator in said selecting portion, wherein, in a case that the first mode is selected before the reservation of the plurality of successive jobs, said controller changes the execution order of the plurality of the reserved jobs so as to decrease the number of times of replacement of said fixing portion, and in a case that the second mode is selected before the reservation of the plurality of successive jobs, said controller maintains the execution order of the plurality of jobs in a reserved order.

7. The image forming apparatus according to claim 6, wherein, in the case that the first mode is selected before the reservation of the plurality of successive jobs, said controller changes the execution order of the plurality of jobs so that the job using said fixing portion mounted in said image forming apparatus is given preference.

8. The image forming apparatus according to claim 6, wherein said selecting portion includes a display portion, and a display controller configured to control a display content at said display portion.

9. The image forming apparatus according to claim 8, wherein said display controller displays a key for selecting the first mode and a key for selecting the second mode at said display portion.

10. The image forming apparatus according to claim 8, wherein said display controller displays a message, prompting the operator to replace said fixing portion, at display portion when the first mode is selected and replacement of said fixing portion is needed.

11. The image forming apparatus according to claim 8, wherein said display controller displays, at said display portion, a selecting screen for selecting one mode from the plurality of modes by an operation, which is an operation of said display portion by the operator, for displaying the selecting screen.

12. The image forming apparatus according to claim 6, further comprising a mounting portion configured to selectively mount one of a plurality of types of fixing portions, including a first fixing portion capable of fixing the toner image on the recording material of a first predetermined type including a predetermined envelope, and a second fixing portion capable of fixing the toner image on the recording material of a second predetermined type not including the predetermined envelope.

13. An image forming apparatus comprising:

an image forming portion configured to form a toner image on a recording material to execute a job;

a fixing portion configured to fix, on the recording material, the toner image formed by said image forming portion;

a mounting portion configured to selectively mount one of a plurality of types of fixing portions, including a first fixing portion capable of fixing the toner image on the recording material of a first predetermined type not including a predetermined envelope, and a second fixing portion capable of fixing the toner image on the recording material of a second predetermined type including the predetermined envelope;

a selecting portion configured to prompt an operator to select one of a plurality of modes, the plurality of modes including a first mode, in which, when a first job using the first fixing portion, a second job using the second fixing portion, a third job using the first fixing portion, and a fourth job using the second fixing portion are successively reserved, in this order, an execution order of the reserved jobs is changed, and a second mode, in which, when the first job, the second job, the third job, and the fourth job are successively reserved, in this order, the execution order of the reserved jobs is not changed; and a controller configured to control the execution order of the reserved jobs, according to the mode selected by the operator in said selecting portion, wherein, in a case that the first mode is selected before the successive reservation of the first job, the second job, the third job, and the fourth job is made during execution of a job using the first fixing portion, said controller changes the execution order of the first job, the second job, the third job, and the fourth job, so as to be executed in order of the first job, the third job, the second job, and the fourth job, and in a case that the second mode is selected before the successive reservation of the first job, the second job, the third job, and the fourth job is made during execution of the job using the first fixing portion, said controller maintains the execution order of the first job, the second job, the third job, and the fourth job, in order of the first job, the second job, the third job, and the fourth job.

14. The image forming apparatus according to claim 13, wherein said selecting portion includes a display portion and a display controller configured to control a display content at said display portion.

15. The image forming apparatus according to claim 14, wherein said display controller displays a key for selecting the first mode, and a key for selecting the second mode at said display portion.

16. The image forming apparatus according to claim 14, wherein, in the case that the first mode is selected by the operator in said selecting portion before the successive reservation of the first job, the second job, the third job, and the fourth job is made during execution of the job using the first fixing portion, said display controller displays a message, prompting the operator to replace the first fixing portion with the second fixing portion, at said display portion with completion of execution of the third job.

17. The image forming apparatus according to claim 14, wherein, in the case that the second mode is selected by the operator in said selecting portion before the reservation of the first job, the second job, the third job, and the fourth job, in this order, said display controller displays a message prompting the operator to replace the first fixing portion with the second fixing portion with completion of execution of the first job, displays a message prompting the operator to replace the second fixing portion with the first fixing portion with completion of execution of the second job, and displays a message prompting the operator to replace the first fixing portion with the second fixing portion with completion of execution of the third job.

18. The image forming apparatus according to claim 14, wherein said display controller displays, at said display portion, a selecting screen for selecting one mode from the plurality of modes by an operation, which is an operation of said display portion by the operator, for displaying the selecting screen.

19. An image forming apparatus comprising:

an image forming portion configured to form a toner image on a recording material to execute a job;

a fixing portion configured to fix, on the recording material, the toner image formed by said image forming portion, said fixing portion being capable of being replaced with another fixing portion depending on a content of the job;

a receiving portion configured to receive information corresponding to one of a plurality of modes selected by an operator, the plurality of modes including a first mode, in which an execution order of a plurality of jobs is changed so as to decrease a number of times of replacement of said fixing portion when the plurality of jobs are successively reserved, and a second mode, in which the execution order of the plurality of jobs is not changed when the plurality of jobs are successively reserved; and a controller configured to control the execution order of the plurality of jobs reserved, according to the mode corresponding to the information received by said receiving portion, wherein, in a case that the information corresponding to the first mode is received by said receiving portion before the reservation of the plurality of successive jobs, said controller changes the execution order of the plurality of the reserved jobs so as to decrease the number of times of replacement of said fixing portion, and in a case that the information corresponding to the second mode is received by said receiving portion before the reservation of the plurality of successive jobs, said controller maintains the execution order of the plurality of jobs in a reserved order.

20. An image forming apparatus comprising:

an image forming portion configured to form a toner image on a recording material to execute a job;

a fixing portion configured to fix, on the recording material, the toner image formed by said image forming portion;

a mounting portion configured to selectively mount one of a plurality of types of fixing portions including a first fixing portion capable of fixing the toner image on the recording material of a first predetermined type not including a first recording material and a second fixing portion capable of fixing the toner image on the recording material of a second predetermined type including the first recording material;

a selecting portion configured to prompt an operator to select one of a plurality of modes, the plurality of modes including a first mode, in which, when a first job using the first fixing portion, a second job using the second fixing portion, a third job using the first fixing portion, and a fourth job using the second fixing portion are successively reserved, in this order, an execution order of the reserved jobs is changed, and a second mode, in which, when the first job, the second job, the third job, and the fourth job are successively reserved, in this order, the execution order of the reserved jobs is not changed; and a controller configured to control the execution order of the reserved jobs, according to the mode selected by the operator in said selecting portion, wherein, in a case that the first mode is selected by the operator in said selecting portion before the successive reservation of the first job, the second job, the third job, and the fourth job is made during execution of a job using the first fixing portion, said controller changes the execution order of the first job, the second job, the third job, and the fourth job, so as to be executed in order of the first job, the third job, the second job, and the fourth job, and in a case that the second mode is selected by the operator in said selecting portion before the successive reservation of the first job, the second job, the third job, and the fourth job is made during execution of the job using the first fixing portion, said controller maintains the execution order of the first job, the second job, the third job, and the fourth job in order of the first job, the second job, the third job, and the fourth job.

21. The image forming apparatus according to claim 20, wherein said selecting portion includes a display portion and a display controller configured to control a display content at said display portion.

22. The image forming apparatus according to claim 21, wherein said display controller displays a key for selecting the first mode, and a key for selecting the second mode at said display portion.

23. The image forming apparatus according to claim 21, wherein, in the case that the first mode is selected by the operator in said selecting portion before the successive reservation of the first job, the second job, the third job, and the fourth job is made, during execution of the job using the first fixing portion, said display controller displays a message prompting the operator to replace the first fixing portion with the second fixing portion at said display portion with completion of execution of the third job.

24. The image forming apparatus according to claim 21, wherein, in the case that the second mode is selected by the operator in said selecting portion before the reservation of the first job, the second job, the third job, and the fourth job, in this order, said display controller displays a message prompting the operator to replace the first fixing portion with the second fixing portion with completion of execution of the first job, displays a message prompting the operator to replace the second fixing portion with the first fixing portion with completion of execution of the second job, and displays a message prompting the operator to replace the first fixing portion with the second fixing portion with completion of execution of the third job.

25. The image forming apparatus according to claim 21, wherein said display controller displays, at said display portion, a selecting screen for selecting one mode from the plurality of modes by an operation, which is an operation of said display portion by the operator, for displaying the selecting screen.

* * * * *